US008938902B2

(12) United States Patent
Atwood

(10) Patent No.: US 8,938,902 B2
(45) Date of Patent: Jan. 27, 2015

(54) SYSTEM AND METHOD FOR CONNECTING ADVERTISING TO FOOTWEAR

(76) Inventor: Steven Craig Atwood, Friendswood, TX (US)

( * ) Notice: Subject to any disclaimer, the term of this patent is extended or adjusted under 35 U.S.C. 154(b) by 0 days.

(21) Appl. No.: 13/488,778

(22) Filed: Jun. 5, 2012

(65) Prior Publication Data

US 2013/0318846 A1 Dec. 5, 2013

(51) Int. Cl.
*G09F 23/00* (2006.01)

(52) U.S. Cl.
USPC ..... 40/636; 40/666; 36/136

(58) Field of Classification Search
CPC ..... A43B 23/30; A43B 21/22; A43B 3/0078
USPC ..... 40/636, 666; 36/136
See application file for complete search history.

(56) References Cited

U.S. PATENT DOCUMENTS

| | | | | | |
|---|---|---|---|---|---|
| RE19,543 | E * | 4/1935 | Winget | 36/72 B |
| 3,095,659 | A * | 7/1963 | McClellan | 36/72 B |
| 3,239,953 | A * | 3/1966 | Norton | 36/72 B |
| 4,660,301 | A * | 4/1987 | Atwood | 36/72 B |
| 5,507,105 | A * | 4/1996 | Cancel | 36/72 B |
| 5,508,899 | A * | 4/1996 | McCormick | 362/103 |
| 5,775,007 | A * | 7/1998 | Expose | 36/72 B |
| 7,730,638 | B2 * | 6/2010 | Urbach et al. | 36/72 B |
| 7,814,685 | B1 * | 10/2010 | Tankson | 36/72 B |
| 2004/0025379 | A1 * | 2/2004 | McDowell | 36/72 B |
| 2005/0229451 | A1 * | 10/2005 | Mullens et al. | 40/500 |
| 2009/0019735 | A1 * | 1/2009 | Parisi | 36/136 |
| 2010/0223816 | A1 * | 9/2010 | Barfield | 36/136 |
| 2013/0086814 | A1 * | 4/2013 | Schindler | 36/50.1 |

* cited by examiner

*Primary Examiner* — Gary Hoge
(74) *Attorney, Agent, or Firm* — Spradley PLLC; Michael Spradley

(57) ABSTRACT

A system and method for connecting advertising to footwear is disclosed. The system can comprise a curved rod member, a sheet, and an advertisement. The curved rod member can be mountable above a welt of a footwear. The sheet material can comprise a first curved surface and a horizontal track along the sheet, wherein the horizontal track can connect the sheet material to the curved rod member, and the advertisement can be on the convex side of the sheet material.

1 Claim, 7 Drawing Sheets

SYSTEM AND METHOD FOR CONNECTING ADVERTISING TO FOOTWEAR

BACKGROUND

This disclosure relates to a system and method for connecting advertising to footwear.

Boots are a preferred footwear around the world for their functionality, durability, style, and comfort. Due to regular use, boots and other footwear become cracked, scraped and scratched. Often these scratch marks are found at the heel of footwear. These types of damage are usually unavoidable since the heel makes contact with various surfaces when performing activities, such as driving or working. Visible marks on footwear can be very unpleasant and can even make new footwear look old. Since damage can occur repeatedly, investment in shoe repair services is both inevitable and costly. Buying new footwear can also be quite expensive.

Consequently, several developments have been made to prevent and protect the rear end of boots or other footwear from being damaged. One of the popularly known methods is by applying gels, creams, lotions, or sprays to protect boots. However, this method only protects footwear from minor scratches and stains, as additional protection is required for the parts of the boot more commonly damaged by wear and tear.

Hence, another method was developed to enhance protection on the heel end of the shoe. One of the shoe guard methods previously designed by the present inventor uses a U-shaped wire rod with a correspondingly shaped plate. Its plate also includes an outwardly extending bevel, which prevents dirt and other elements from being lodged between the shoe guard and the shoes. Nevertheless, due to the plate's curved shape, this design only covers a small part of the footwear's upper heel and leaves the lower heel exposed to damage. Additionally, the upper edge of the sheet uses a protruding edge surface which can still collect small dirt and/or other small particles. Aside from functional defects, such a protruding edge surface of the plate may not look aesthetically pleasant against the sleek design of footwear. Flaws are also present in the design of the method's metallic rod, which uses an extended leg that bends outwardly. Although the rod may help keep the shoe guard in place, it still causes some damage on boots or any footwear during installation and/or removal due to its cylindrical sharp edges.

As such, it would be useful to have a system and method for connecting advertising to footwear.

SUMMARY

A system and method for connecting advertising to footwear is disclosed. The system can comprise a curved rod member, a sheet, and an advertisement. The curved rod member can be mountable above a welt of a footwear. The sheet material can comprise a first curved surface and a horizontal track along the sheet, wherein the horizontal track can connect the sheet material to the curved rod member, and the advertisement can be on the convex side of the sheet material.

A method for connecting advertising to footwear is disclosed. The method can comprise a curved rod member, a sheet, and an advertisement. The curved rod member can be mountable above a welt of a footwear. The sheet material can comprise a first curved surface and a horizontal track along the sheet, wherein the horizontal track can connect the sheet material to the curved rod member, and the advertisement can be on the convex side of the sheet material. The method can further comprise steps of removing the sheet from the rod member, and connecting a second sheet to the rod member, wherein the second sheet can comprise a second advertisement. Moreover, the method can also comprise steps of removing the advertisement from the sheet, and connecting a second advertisement to the sheet.

DETAILED DESCRIPTION

Described herein is a system and method for protecting the heel area of footwear. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
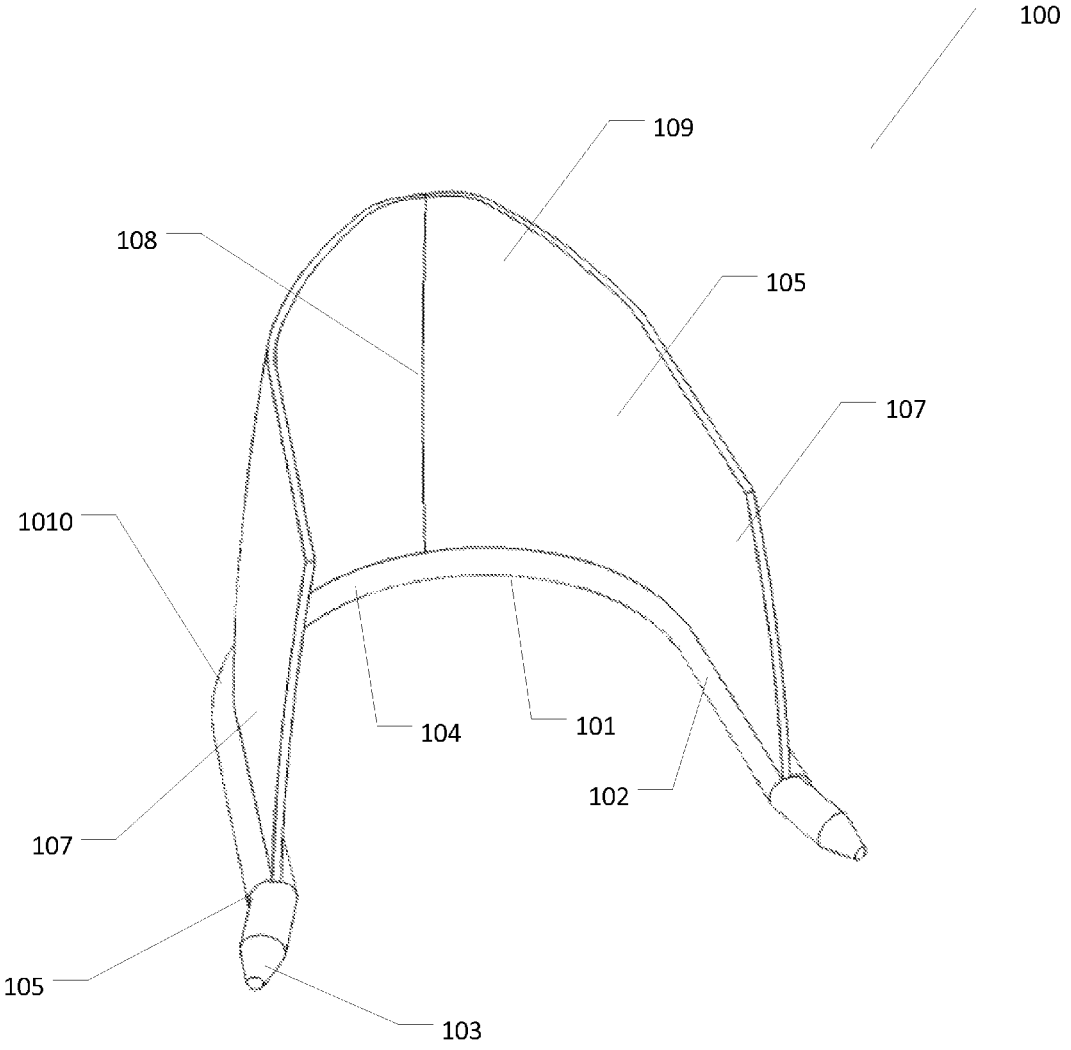
FIG. 1 illustrates a heel protector.
Figure 1B:
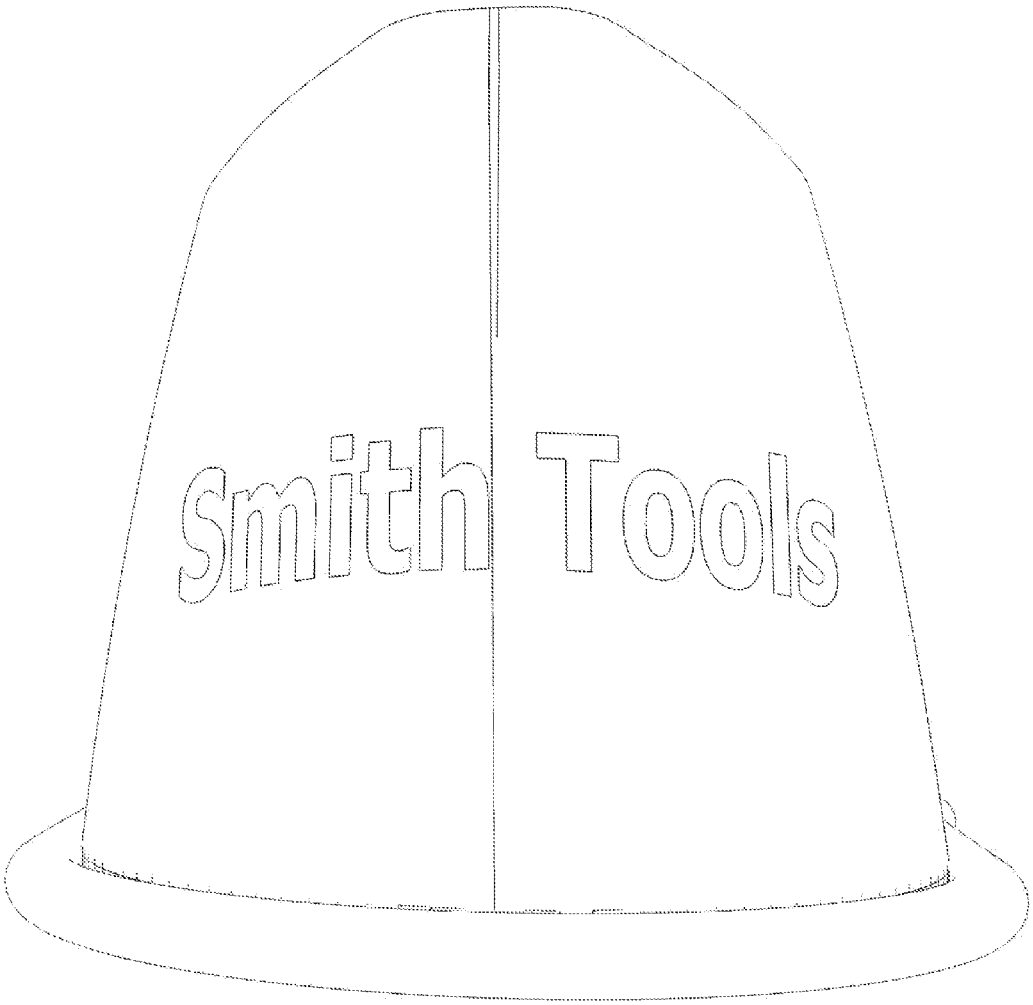

FIG. 1 illustrates a heel protector 100. Heel protector 100 can comprise a rod member 101 and a sheet 106. Rod member 101 can comprise of a pair of slightly inward extending members 102, a pair of extended members 103 and a rearward portion 104. In one embodiment, extended members 103 can be joined permanently with inward members 102 and rearward portion 104, forming a single body. The ends of extended members 103 can be conical in shape to ensure that boots are not scratched and damaged during installation of heel protector 100. In such embodiment, rod member 101 furthermore can be made from any materials such as metal or plastic that can be bent and/or curved inwardly to form a rearward circular-shaped portion 105. As such, rod member 101 can generally form a U-shape.

Sheet 106 can comprise side portions 107, a rearward portion 108, upper rearward portion 109, and a curved sheet holder 1010. Further, sheet 106 can be made from materials including, but not limited to, thin metal, plastic, or rubber materials. Various types of engravings or other design materials can be decorated in the visible surface of sheet 106. Sheet 106 can be clear, or can have any kind of color and/or textures. Further, the visible outer surface of sheet 106 can be affixed with logos, and/or brands. The logo or brand can be of a company having nothing to do with the manufacture, distribution, and/or sale of the heel protector. Hence, heel protector 100 can be used as an effective form of advertisement for items other than the heel protector. Such advertising can be words, pictures, or a combination of both.

In one embodiment sheet 106 can be permanently attached to rod member 101 by a weld, adhesives, and/or other bonding materials and/or methods. In another embodiment sheet 106 can be removable and easily detached from rod member 101. In such embodiment, sheet 106 can comprise a groove that rod member 101 can snap into. As such, sheet 106 can be replaceable and/or reusable. In another embodiment sheet 106 and rod member 101 can be designed as one single piece of material.

Figure 2:
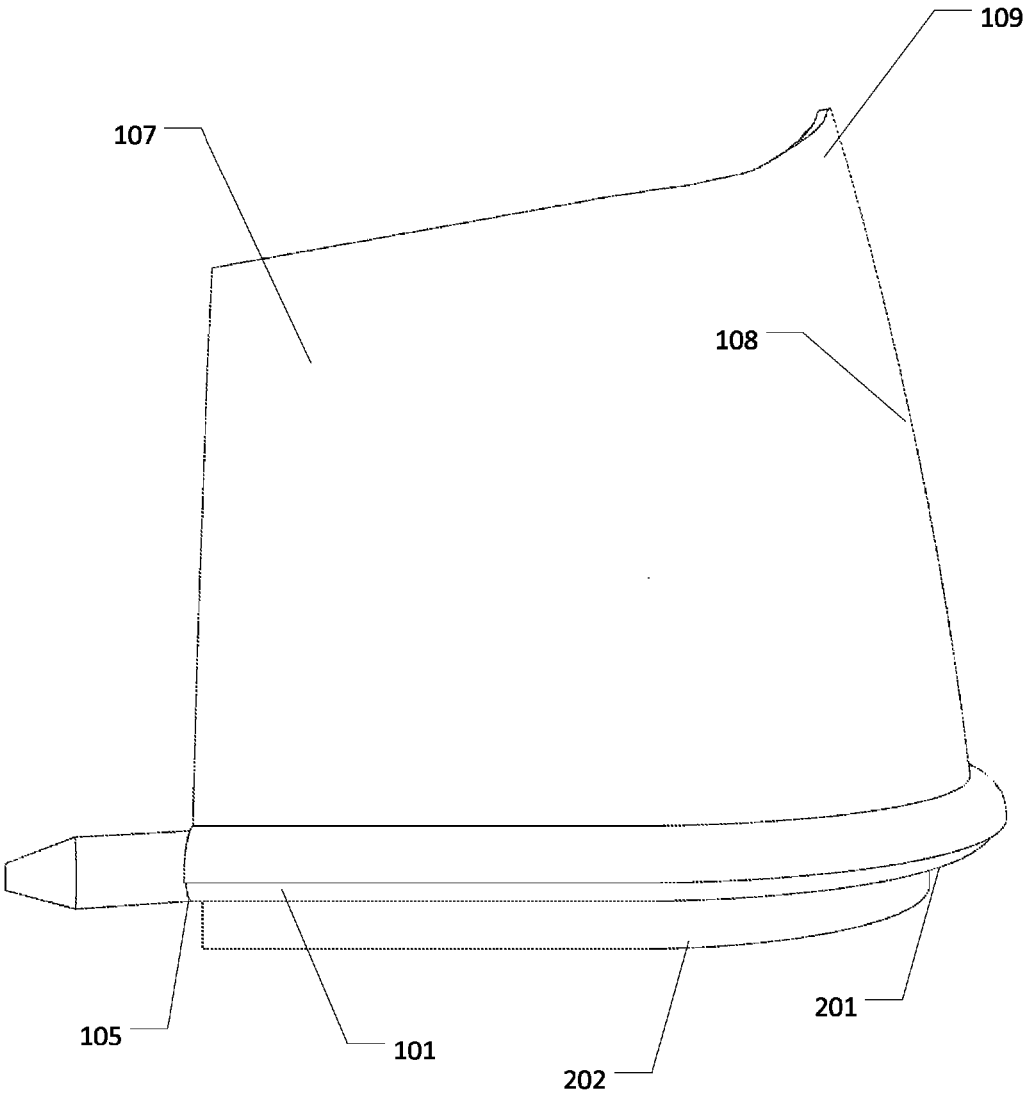
FIG. 2 illustrates the curvature of rearward portion.

FIG. 2 illustrates the curvature of rearward portion 108. In one embodiment, the middle curvature of rearward portion 108 can curve slightly inward up to upper rearward portion 109, so that the rear end portion 201 of rod member 101 can be outward of rearward portion 108. Upper rearward portion 108 can be extended upward from rod member 101, allowing sheet 106 to cover a larger rear end portion of a heel. In one embodiment, sheet 106 can have lower portion 202, which can extend downward from rod member 101 and add protection to heel portion of boots. In such embodiment, the rearward of lower portion 202 can be slightly curved inward. In one scenario, the rearward of lower portion 202 can extend horizontally and perpendicular to rearward circular-shaped portion 105 while in another, lower portion 202 can extend downward and perpendicular to rearward circular-shaped portion 105. Lower portion 202 can create a larger space for designs.

Figure 3:
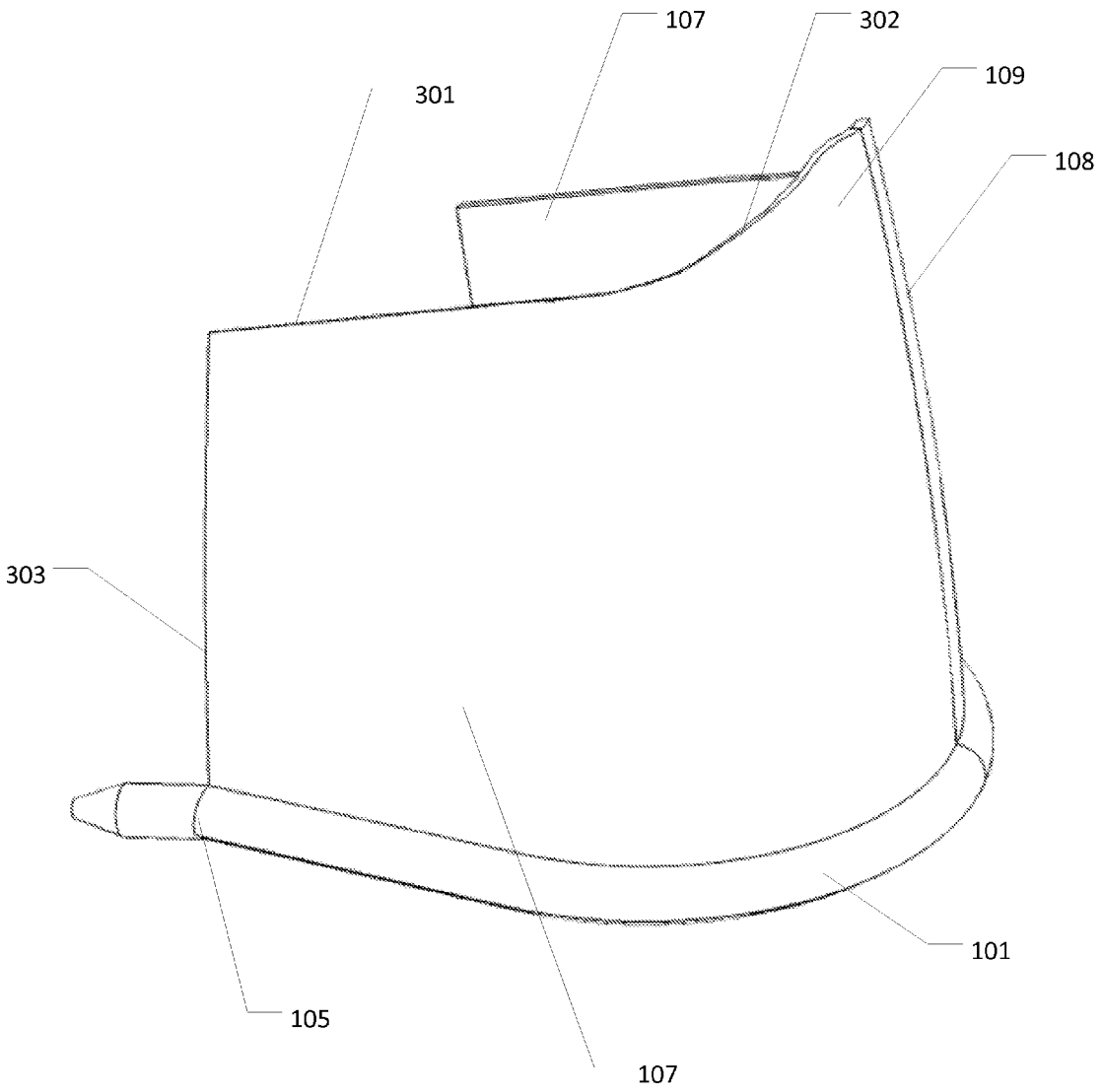
FIG. 3 illustrates the design of sheet.

FIG. 3 illustrates the design of sheet 106. In one embodiment, the left and right side portion 107 of sheet 106 can be extended horizontally from rearward circular-shaped portion 105 up to rearward portion 108. From rod member 101, the side portion 107 of sheet 106 slightly can curve inward and extends upward. As such, side portions 107 of sheet 106 do not protrude side portions of rod member 101, and can follow the contour of footwear.

Moreover, from the upper edges 301 of side portions 107, sheet 106 can form an upward slope towards upper rearward portion 109. In such embodiment, upper edges 301 can slope slightly upward as it moves to slope portion 302 and then curves slightly upward towards the upper edge of upper rearward portion 109. In such embodiment, edges 301 and 303 can be rounded in shape in order to avoid sharp edges that can scratch or damage the footwear.

Sheet 106 can be extended sideward and upward to permit a larger coverage and protection of the rear end portion of the boots. In one embodiment, outward bevels that can protrude rod member 101 can be avoided for both a sleeker look and to prevent small particles or dirt from collecting on any protruding edges of sheet 106.

Figure 4:
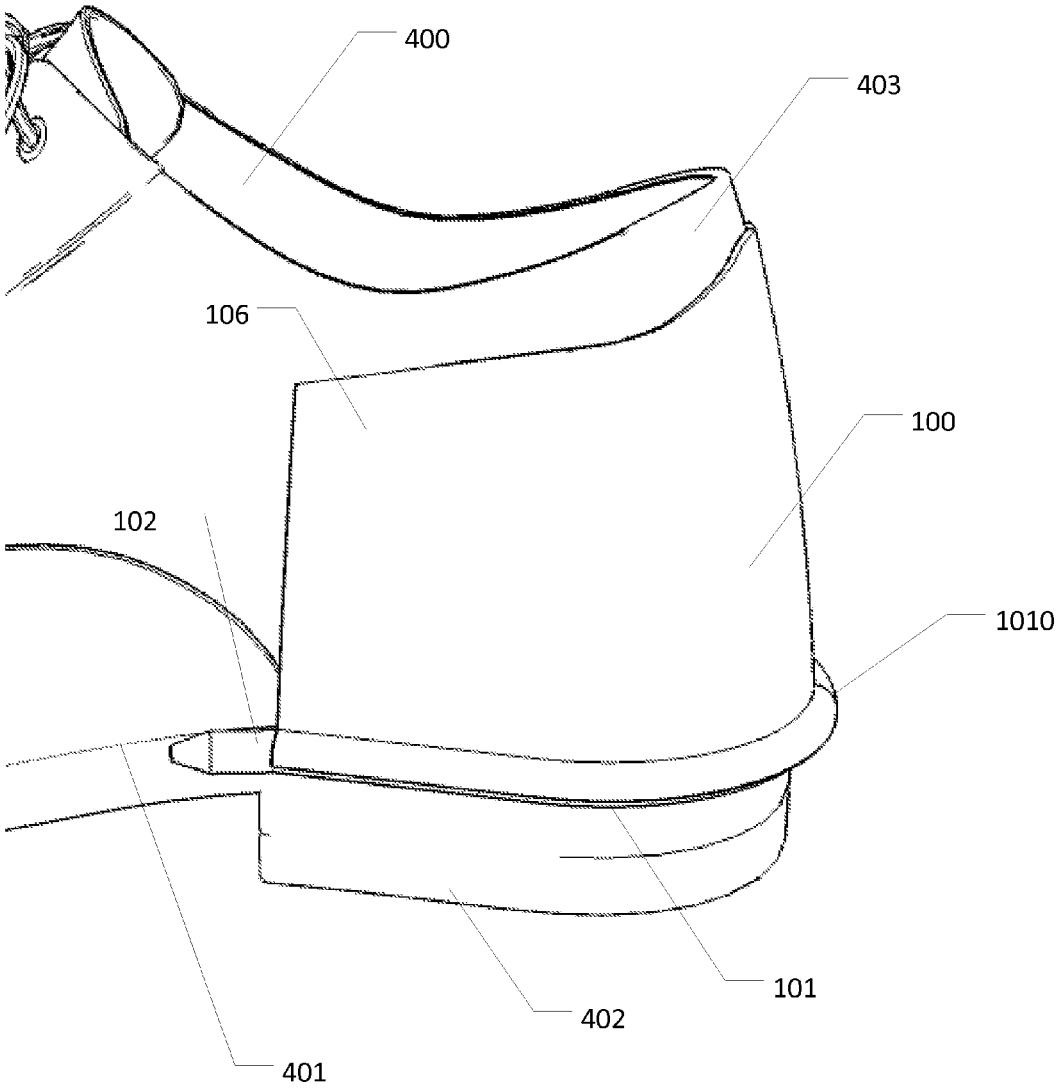
FIG. 4 illustrates how heel protector can be secured to boots.

FIG. 4 illustrates how heel protector 100 can be secured to boots 400. Footwear 400 can comprise of a welt 401, a sole 402, and an upper boot portion 403. Welt 401 is a strip that normally extends around boots 400. However, welt 401 can extend to create a surface between sole 402 and upper boot portion 403 and allow for rod member 101 to be formed to fit snugly on top of welt 401.

When attaching heel protector 100 to footwear 400, the U-shaped opening of rod member 101 should face the rear end portion of footwear 400. Thus, rod member 101 can be placed at the surface of welt 501. In one embodiment, heel protector 100 can be slightly pushed towards footwear 400 during installation until rearward portion 108 of sheet 106 touches the heel. In such embodiment, the inward extending member 102 can be pushed outwardly, allowing heel protector 100 to slide easily to footwear 400. Once heel protector 100 is in place, the inward extending member 102 returns to its normal form, clasping securely onto the side portion of footwear 400. Moreover, extended members 104 which can extend and slope outward, can prevent scratching or damaging the footwear during installation. Rod member 101 can be pressed adjacent to footwear 400, and curved sheet holder 1010 can be positioned at the outer surface of rod member 101, making rod member 101 slightly visible.

Figure 5:
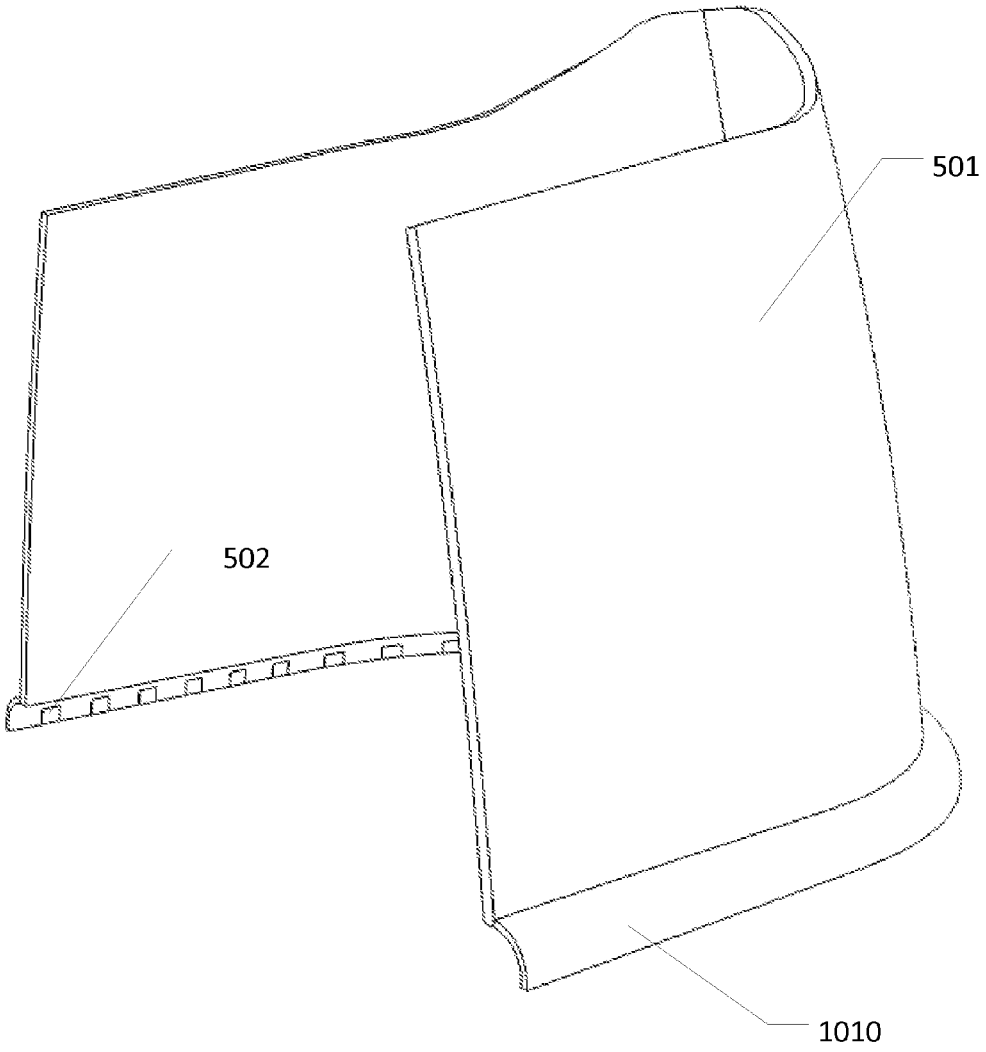
FIG. 5 illustrates a second sheet.

FIG. 5 illustrates a second sheet 501. In an embodiment wherein sheet 106 is detachable, second sheet 501 can be used as a replacement for sheet 106. Similarly, second sheet 501 can be configured exactly like sheet 106 and both can be attachable and detachable. Such embodiment of second sheet 501 can be strained inwardly in order to be secured tightly unto rod member 101. Alternatively, in said embodiment, curved sheet holder 1010 can have an extended member or can form a semi-circle for better hold and security unto rod member 101. Additionally, one or more small fasteners 502, in such embodiment, can be used to make sure sheet 501 is securely in place. The fastener can be any fastener known in the art, such as snaps or hook and loop fasteners.

Figure 6:
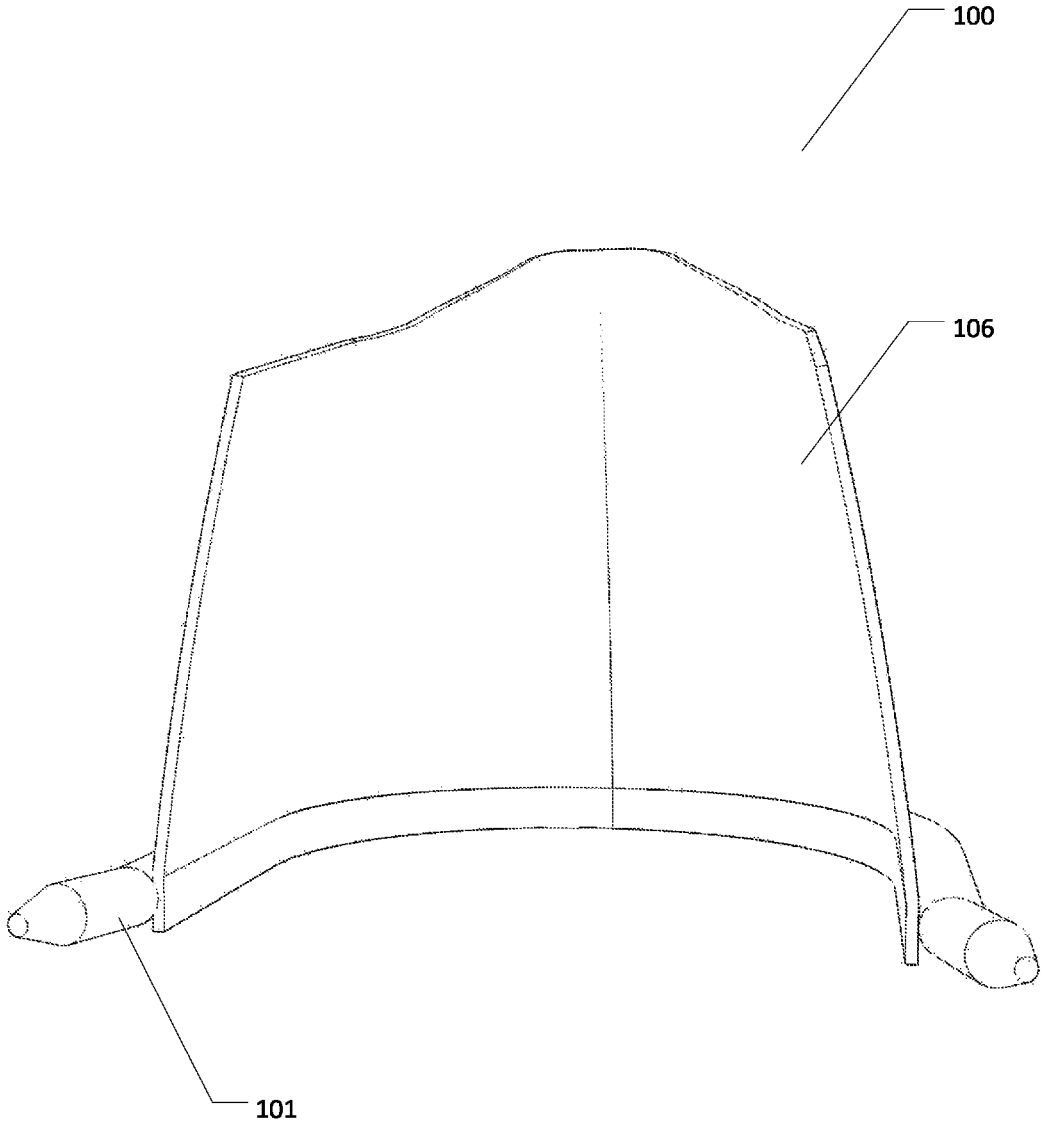
FIG. 6 illustrates an embodiment of heel protector wherein sheet resides within the inner curve of rod member.

FIG. 6 illustrates an embodiment of heel protector 100 wherein sheet 106 resides within the inner curve of rod member 101. In such embodiment, sheet 106 can help prevent rod member from damaging footwear 400 during installation.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method for advertising on footwear comprising the step of connecting a curved rod member mountable above a welt of a shoe; and a sheet material comprising a first curved surface and a horizontal track along said sheet, wherein said horizontal track connects said sheet material to said curved rod member; and an advertisement on the convex side of said sheet material removing said sheet from said rod member, and connecting a second sheet to said rod member, said second sheet comprising a second advertisement.

* * * * *